US005551533A

United States Patent [19]

Ng

[11] Patent Number: 5,551,533

[45] Date of Patent: Sep. 3, 1996

[54] AUDIO DIRECTION AND INFORMATION FOR ELEVATOR PASSENGERS

[75] Inventor: Bok S. Ng, Singapore, Singapore

[73] Assignee: Otis Elevator Company, Farmington, Conn.

[21] Appl. No.: 222,135

[22] Filed: Apr. 1, 1994

[51] Int. Cl.[6] ..... B66B 1/34; B66B 3/00

[52] U.S. Cl. ..... 187/391; 187/397; 187/390

[58] Field of Search ..... 187/390, 361, 187/396, 397, 398, 901, 902

[56] References Cited

U.S. PATENT DOCUMENTS

| | | | |
|---|---|---|---|
| 4,275,274 | 6/1981 | English | 369/22 |
| 4,375,637 | 3/1983 | Desjardins | 340/517 |
| 4,400,786 | 8/1983 | Mandel et al. | 364/513 |
| 4,400,787 | 8/1983 | Mandel et al. | 364/513 |
| 4,958,707 | 9/1990 | Yoenda et al. | 187/101 |
| 4,995,479 | 2/1991 | Fujiwara et al. | 187/135 |
| 5,023,409 | 6/1991 | Wilson | 187/130 |
| 5,042,620 | 8/1991 | Yoenda et al. | 187/124 |
| 5,271,484 | 12/1993 | Bahjat et al. | 187/29.1 |
| 5,317,114 | 5/1994 | Pullela et al. | 187/128 |

*Primary Examiner*—Robert Nappi

[57] ABSTRACT

A speaker system is provided adjacent to the gate of each of a plurality of elevator cars on each floor of a building. The speaker systems announce messages such as the car number of the next car in either direction, the estimated time of arrival of the car, that the car is full, the approximate delay for service by the next car to come, the car number and floor numbers being served by each loading elevator during up peak with channeling, the up calls are prohibited during up peak, the delay for service by the next car, and that all elevators should not be used in the case of fire or other emergency. Speaker systems are put on the doors of each stairwell on every floor, thereby to direct passengers toward the stairs in case of emergency. The system not only provides information and identification, it also provides audible, directional cues to assist the passengers in locating the service which they are to seek.

26 Claims, 10 Drawing Sheets

INCR n
55
n = TOP FLR
56
N
Y
EMS EARLY ANOUNC
63
N
Y
E.T.A. = THRESHOLD TIME VALUE-4 SEC
E = MAX
65
E.T.A. ≥ E.T. (E)
66
Y
N
NEW E.T.A. MSG = MSG (E)
69
DECR E
67
E = MIN
68
N
NEW E.T.A. MSG = BLANK
70
NEW E.T.A. MSG = OLD E.T.A. MSG
71
N
OLD E.T.A. MSG = NEW E.T.A. MSG
SEND NEW E.T.A. MSG TO CRS
72
GROUP AUD-2
64

| | |
|---|---|
| FIG. 6A | FIG. 6B |
| FIG. 6C | FIG. 6D |

AUDIO DIRECTION AND INFORMATION FOR ELEVATOR PASSENGERS

TECHNICAL FIELD

This invention relates to providing audible direction and audible information to elevator passengers.

BACKGROUND ART

In buildings having a number of elevators and more than a few floors, the peak traffic periods (morning and evening) may be provided with special traffic handling service called "channeling". In this method of service, instead of all of the elevators serving all of the floors, the floors are divided into distinct, contiguous groups, with each elevator on each trip serving only one of the groups, thereby concentrating the stops which the elevator must make to only a few floors, instead of all the floors in the building. During down peak (evening), passengers easily select the right elevator because only the elevator serving the group will stop at floors for down calls. On the other hand, during up peak (morning), a passenger must determine which elevator is serving the group of floors within which the destination lies. Because each elevator has a different distance to travel round trip, depending on the channeling group it serves, the elevators are assigned to a next group of floors in turn as each elevator approaches the lobby for another run. Therefore, each elevator services successively different groups in dependence upon the particular number of elevators in service, number of groups being served, round trip run times, and the like. Therefore, even for passengers who enter the building day after day, it is impossible for them to know which elevator will serve them each morning. Therefore, elevator systems which employ channeling have floor enunciator panels, usually electroluminescent displays (ELDs), adjacent to or above the doors of each elevator so that as an elevator approaches the lobby floor, the panel indicates to potential passengers which floors the elevator will serve on the next trip. This permits the passengers to congregate at the elevator and board it when the time is appropriate. In more sophisticated elevator channeling systems, not only does the assignment of a group to each elevator change, the floors within a group will change from time to time, depending upon the traffic patterns and the optimum grouping of floors. Channeling systems of this type are shown in U.S. Pat. Nos. 4,838,384 and 4,846,311. While it may be relatively simple to listen for a gong and look for an enunciator light to determine which car is the next car up in a non-channeling system, actually reading the numbers on the panels of a channeling system is a lot more difficult. For vision impaired persons, determining which elevator to take can be totally impossible.

In handling traffic during up peak in systems that don't employ channeling, or in handling traffic at non-lobby floors, the situation is somewhat simpler since each car has an enunciator or lantern which typically includes both a light and a sounding device such as a chime. Typically, the particular direction from which the single sounding of a chime comes may not assist a passenger in determining which elevator will provide service, and sometimes the lights are difficult to see. For those who are color blind, the color of the light may be no clue as to whether the car is going up or down; the information eludes visually impaired persons.

In some elevator systems, operation in an up-peak traffic mode mandates the lack of upward service from any floors except the lobby, because such service disrupts the channeling or other up-peak traffic scheme. In such cases, passengers must first travel to the lobby and then travel upwardly to the floor of destination. For passengers who are not familiar with this mode of operation, the inability to register an up call can be disconcerting indeed.

In a similar fashion, the mere inability to react properly with an elevator system is stressful to some passengers. Thus, the fact that there does not appear to be any response from the system can be the most disconcerting of all. Furthermore, even though the system indicates recognition of the desire for service, if the service is not forthcoming within some reasonable time, passengers can become fretful about whether or not service will ever be forthcoming. Therefore, long delays in responding to a call can be extremely stressful to some passengers.

During fires and other emergencies, elevators are to be used only by professionals (such as firemen) and are not available to passengers. Therefore, elevators typically are simply non-responsive to passengers, which adds to their panic in an emergency situation. Although stairs are supposed to be utilized, there typically is no indication at an elevator as to which direction the nearest stairs are. If there is such an indication, it is typically a visible sign which may or may not be seen, particularly in the event of smoke, or loss of power for illumination, and so forth, or by visually impaired persons.

A similar situation may exist for passengers unfamiliar with a building whenever a double deck elevator is in use. In such systems, all of the passengers who are heading for an even numbered floor will utilize one elevator lobby which provides access to one of the decks of the double deck elevator, while those heading for an odd numbered floor will utilize a different elevator lobby which provide access to the opposite deck of the elevator car. Then, as it travels upwardly in the building, each time that a car stops, one set of passengers are allowed access to an even numbered floor while the other set of passengers are simultaneously allowed access to an odd numbered floor. In this way, two floors are satisfied with each stop of the elevator, and a single elevator shaft can carry twice the normal number of passengers during the up-peak mode of operation. During down peak, the converse is true and passengers will enter whichever deck of the elevator is presented to the floor from which they request service, so there is no problem.

During periods of heavy traffic, it is sometimes difficult for a passenger to know whether he should push into a crowded elevator car or wait for the next car; this problem can become worse if the passengers should enter as a group, such as may be true with an adult accompanying several children. It is hard to tell if the car is really full, and for persons in a hurry, it is hard to know how long it may take before another car may provide service.

For some people, the mere usage of elevators provides anxiety (not unlike that for those with a fear of flying). All of the foregoing problems are compounded for those persons for whom use of elevator systems is stressful.

DISCLOSURE OF INVENTION

Objects of the invention include provision of directional cues to elevator passengers, provision of improved instructions to elevator passengers, and reducing stress induced in elevator passengers as a consequence of their utilization of the elevator system and/or the response of the elevator system to them.

According to the present invention, elevator passengers are provided with direction to impending service audibly, by virtue of messages provided over loud speakers which are co-located with the service which they should seek.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
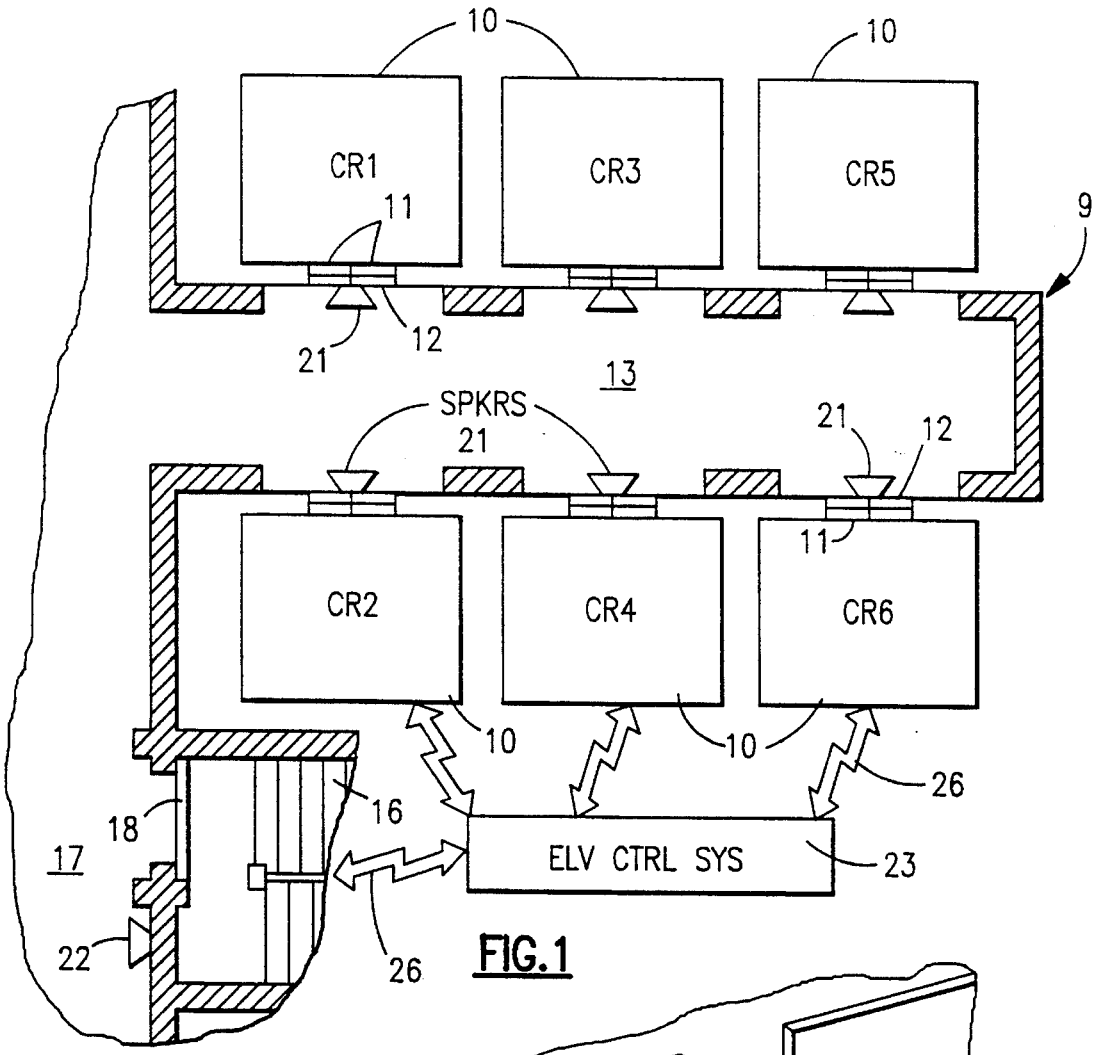
FIG. 1 is a partial, sectioned plan view of a bank of elevators and a stairwell according to the invention.
Figure 2:
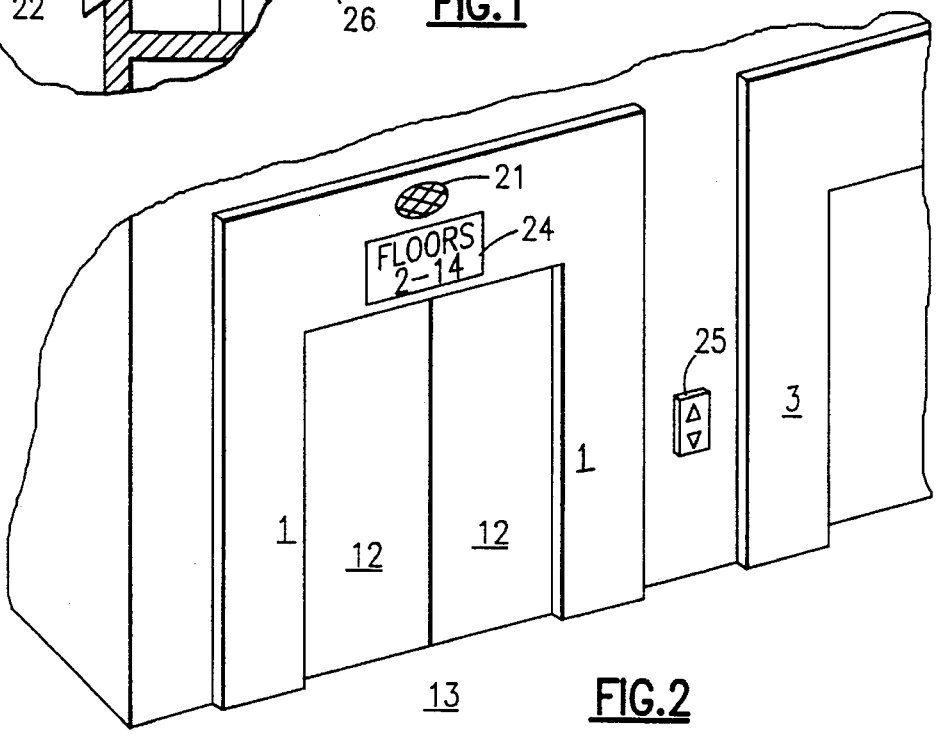
FIG. 2 is a partial perspective view of the facade of one of the elevators of FIG. 1.

Referring to FIG. 1, an elevator system 9 includes a plurality of elevators, each having an elevator car 10, with access through doors 11 and gates 12 to a corridor 13. On each floor, the elevator passengers may have access to an emergency stairwell 16 by means of a hallway 17 through a door 18. According to the invention, each of the cars 10 has a speaker system 21 physically associated with the gates 12 of the car on each floor of the building. In accordance further with the invention, each stairwell 16 in the building has a speaker system 22 associated with the stairwell door 16 on each of the floors of the building. The speakers 21, 22 are associated with the respective gates 12 and doors 16 so as to provide audible directional guidance toward the related gates and doors; this is an important aspect of the present invention. The elements of the elevator system 9, including the speakers 21, 22, are all responsive to an elevator control system 23, which communicates with the elevator cars 10, the speakers 21, 22, hall lanterns 24 (FIG. 2) and hall call buttons 25 by means of serial communication links 26. In an elevator system which employs channeling during peak traffic periods, the lobby hall lantern 24 will comprise a floor display panel as shown in FIG. 2. The elevator control system shown in U.S. Pat. No. 5,202,540 and U.S. Pat. No. 5,271,484 is a distributed system with an operational control subsystem data processor associated with each elevator for performing motion, door control and other functions with respect to each car, as well as performing group functions by means of distributed processing. However, a single processor may be utilized for all of the group and car functions, or separate processors may be used in any combination, all of which is wholly irrelevant to the present invention. Each speaker system 22 includes an audio acoustic transducer, such as a typical loudspeaker, and a speech synthesizer, which may typically comprise a ROM module having codes for predetermined audible messages, as described hereinafter. The manner in which digital signals cause the audible messages is also irrelevant to the present invention.

Figures 3, 3A, 3B:
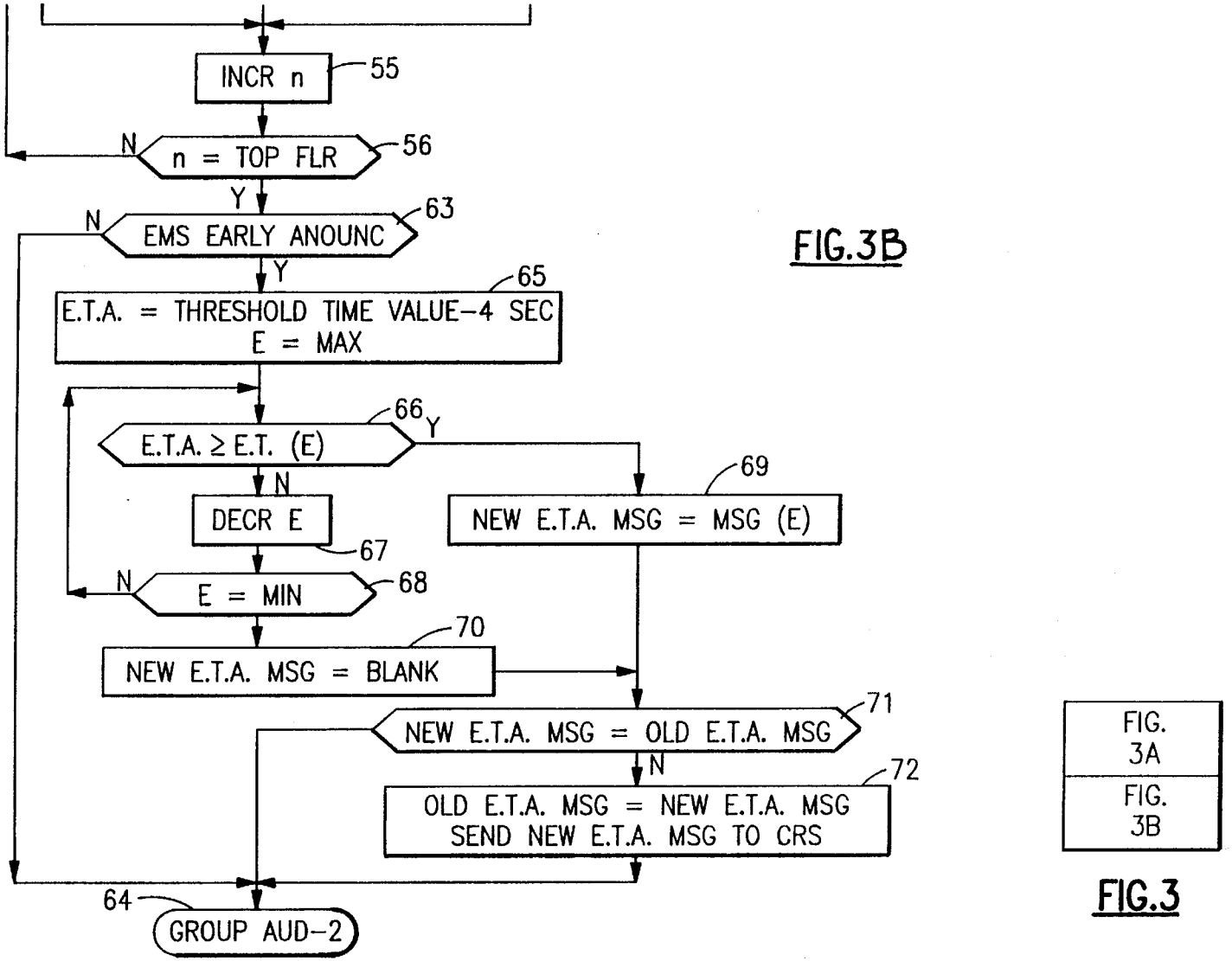
FIGS. 3, 3*a*, 3*b*, 4 & 5 are a logic flow diagram of a group audio control routine in accordance with the invention.
Figure 3A:
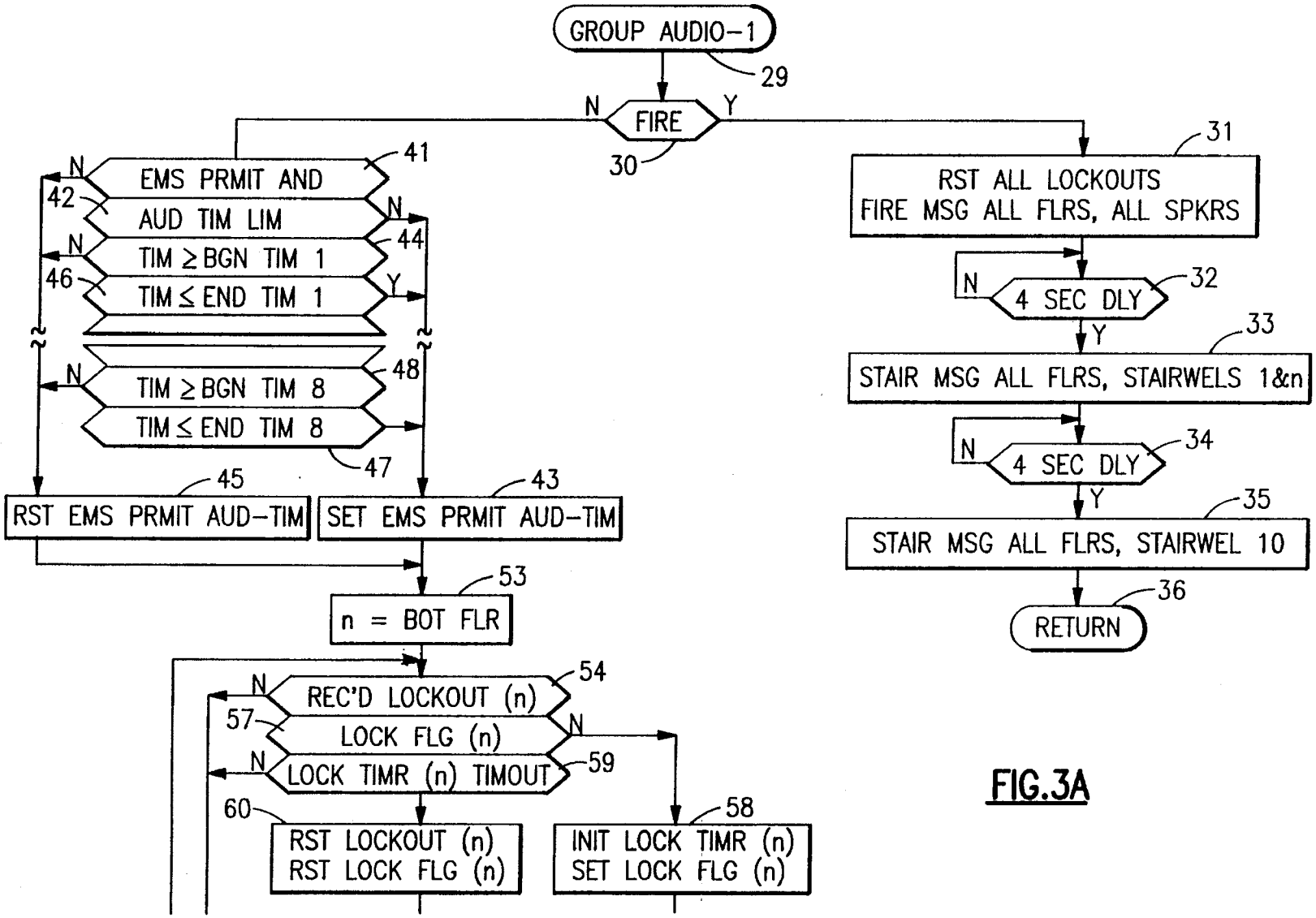

Referring now to FIG. 3, a group audio control routine, provides exemplary combinations of functions which may be performed by the elevator control system 23 in order to implement the present invention. The group audio routine is reached through an entry point 29 and a first test 30 determines if a fire mode of operation is in process or not. This test could also test for emergencies in general, and could include appropriate messages in addition to or as substitutes for those described. If a fire mode of operation is in process, an affirmative result of test 30 reaches a pair of steps 31 to reset all lockouts. As is described more fully hereinafter, a lockout is the blocking of messages to any one of the speakers 10, 22 which might be within earshot of another one of the speakers 10, 22 whenever such other speaker is being utilized, to avoid mixing of audible messages which could cause them to become unintelligible. In the embodiment herein, it is anticipated that at the time of causing any audible message, the lockout for the area where that message is to be announced is checked to see if some other message has caused a lockout, and if not, the area is locked out while the current message is made. This is under control of the group, as described hereinafter, and in the present embodiment the lockouts simply last for a period of time just longer than the lengths of the typical messages. In the steps 31, all lockouts are reset so that the group can force the speakers to announce the emergency messages. In the steps 31, a fire message is sent to all elevator speakers 21 on all floors; this message might be: "Elevators are not to be used during emergency. Use stairwells", or the like. Then, a four second delay loop 32 provides time for the fire message to be announced before reaching a step 33 where a stair message is sent to all floors of stairwells that are sufficiently far apart, here indicated as stairwell 1 and stairwell 10, so that their messages will not interfere with one another. The stair message might be "Use this stairwell to exit the building", or some other suitable message. After another four second delay 34, additional stair messages are sent to all the floors of one or more stairwells which do not interfere with each other, successively until finally all of the stairwell messages have been made, including the message at stairwell 10 in the step 35. And then other parts of the computer program are reverted to through a return point 36. So long as the emergency continues, each time that the group audio routine is reached through the entry point 29, an affirmative result of test 30 will cause the elevator and stair messages to be repeated, by the steps and tests 31–35. In a typical elevator controller, a routine of this type can be reached as many as ten times per second, or more, if needed. Thus, the messages will be repeated in an uninterfering manner as frequently as is possible (determined by the delays 32, 34) without interfering with each other.

Assuming there is no emergency, a negative result of test 30 will reach a test 41 to determine if the elevator management system has currently been set to permit use of the audio messages of the invention to guide passengers to elevators and provide information for elevator passengers, in accordance with the invention. As is described more fully with respect to FIG. 6 hereinafter, the elevator car messages can be precluded if desired, for any reason, by the building management. Assuming that audio messages are to be permitted, an affirmative result of test 41 reaches a test 42 to determine if there is any time limit on audible messages (such as might be desirable on hospital corridors after visiting hours). If there is no time limit, a negative result of test 42 reaches a step 43 to set a flag indicative of the fact that the elevator management system does permit audio messages, with respect to time (in contrast with elevator by elevator as described with respect to FIG. 6 hereinafter). If, however, the EMS has placed time limits on the use of audio messages, an affirmative result of test 42 reaches a test 44 to determine if the beginning of a first permissible audio time period has been reached; if not, a negative result of test 44 bypasses the step 43 and instead reaches a step 45 to reset the flag, thereby no longer indicating that the elevator management system permits audio, with respect to the current time. But if the beginning of a first permitted audio period has occurred, an affirmative result of test 44 reaches a test 46 to see if the end of the first audio permission period has been reached, or not. If it has not, an affirmative result of test 46 will reach the step 43 to permit audio messages. In a similar fashion, other tests 47 and 48 determine whether the current time is within any other audio permission time periods, or not.

Next, there is a small subroutine to handle lockouts. A step 53 sets a floor factor, n, to the number of the bottom floor of the building. This number is used to step from floor to floor to determine if any lockouts need to be handled. A first test 54 determines if any lockout request has been received from floor n, and if not, a negative result reaches a step 55 where n is incremented; a test 56 determines if all floors have been tested. If not, the test 54 is reached for the next floor, in turn. Then a test 57 determines if a lock flag has yet been set. Upon the first pass after sensing a lockout request for any floor, the test 55 will be negative reaching a pair of steps 58 in which a lockout timer is initiated and the lock flag is set. The reason for the lock flag is to keep track of the fact that a lockout is in progress for this floor, as the subroutine steps through other floors, and eventually, the program reverts to other programming (not shown) before returning to the test 54 with respect to the particular floor currently in question. Then, the step and test 55, 56 cause the test 54 to examine the next floor in turn. The next time that the routine of FIG. 3 passes through the test 57 with respect to a floor for which the lockout timer has been initiated and the lock flag has been set, test 57 will be affirmative reaching a test 59 to determine if the timer has timed out or not. Initially, it will not so a negative result of test 59 will cause the step and test 55, 56 to reach the test 54 for the next floor in turn. Eventually, with respect to any given floor, the lockout timer for that floor will have timed out and an affirmative result of test 59 will reach a pair of steps 60 which resets the lockout for that floor (thus enabling the same or other speakers to send additional messages in that corridor) and the lock flag for that floor is reset, in preparation for the next message-related lockout which is to be handled on that floor.

When all the floors have been tested and handled in each pass through the routine of FIG. 3, an affirmative result of the test 56 will reach another subroutine in which a message for an estimated time of arrival is prepared and made available to the cars. A test 63 determines if the elevator management system is utilizing early announcement. This is a feature which causes the reassignment of hall calls to various cars only until such time as the time for an assigned elevator to respond to the call is within some threshold of time. A system of this type is described in the aforementioned '484 patent. If early announcement is not being utilized in any implementation of the invention, or at the particular time that the routine of FIG. 3 is being run, then a negative result of test 63 bypasses the remaining steps and tests of this subroutine and reaches a transfer point 64 to advance the routine to FIG. 4. If early announcement is not in use, it is assumed that hall call assignments are being made in accordance with relative system response techniques which are described in U.S. Pat. Nos. 4,363,381 and 4,815,568, in which case assignments are continuously remade until a car having a stop assignment for a floor reaches the stop control point for that floor (that floor becomes the committable floor of the car), at which time the assignment is made final and the car answers the call. One feature of the invention is that when early announcement is being utilized, passengers can be advised early of which elevator will answer the call and how long it will be before that elevator arrives. In FIG. 3, an affirmative result of test 63 reaches a pair of steps 65 in which an estimated time of arrival factor (E.T.A.) is set equal to the threshold time value of the aforementioned '484 patent (that is, the length of time remaining for a car to reach a call before that call assignment is made final for that car), minus 4 seconds, which is a time long enough to permit making the message relating to the E.T.A. And, a working factor, E, is set to some maximum value. This is used to find a preestablished message that suitably corresponds with the value of E.T.A. which has just been determined. A test 66 determines if E.T.A. exceeds a first estimated time for the first setting of E; if not, a step 67 decrements E and-until the minimum value of E is reached, a test 68 will cause the subroutine to revert to the test 66. When the value of E.T.A. equals or exceeds the corresponding value for the factor E, an affirmative result of test 66 reaches a step 69 which establishes a new E.T.A. message as the message corresponding to the factor E. This might be, for instance, "60 seconds", or, if desired, "next up car in 60 seconds". If successive negative results of test 66 cause decrementing E in step 67 until E is less than some minimum amount, this means that the amount of remaining time is so small that there is no point in announcing it (such as four or five seconds), because the car will be there by the time the message has ended. But if that is the case, then no message is required so the new E.T.A. message is set equal to a blank (a period of quiet in a step 70.) Following either step 69 or 70 where a correct E.T.A. message is established, a test 71 determines if the new message is the same as the old one. If not, a series of steps 72 will set the old E.T.A. message to be equal to the new one, and send the new one to the cars for their use. But if the old and new message are the same, the steps 72 are bypassed and the next portion of the group audio control routine is reached through the transfer point 64, in FIG. 4.

Figure 4:
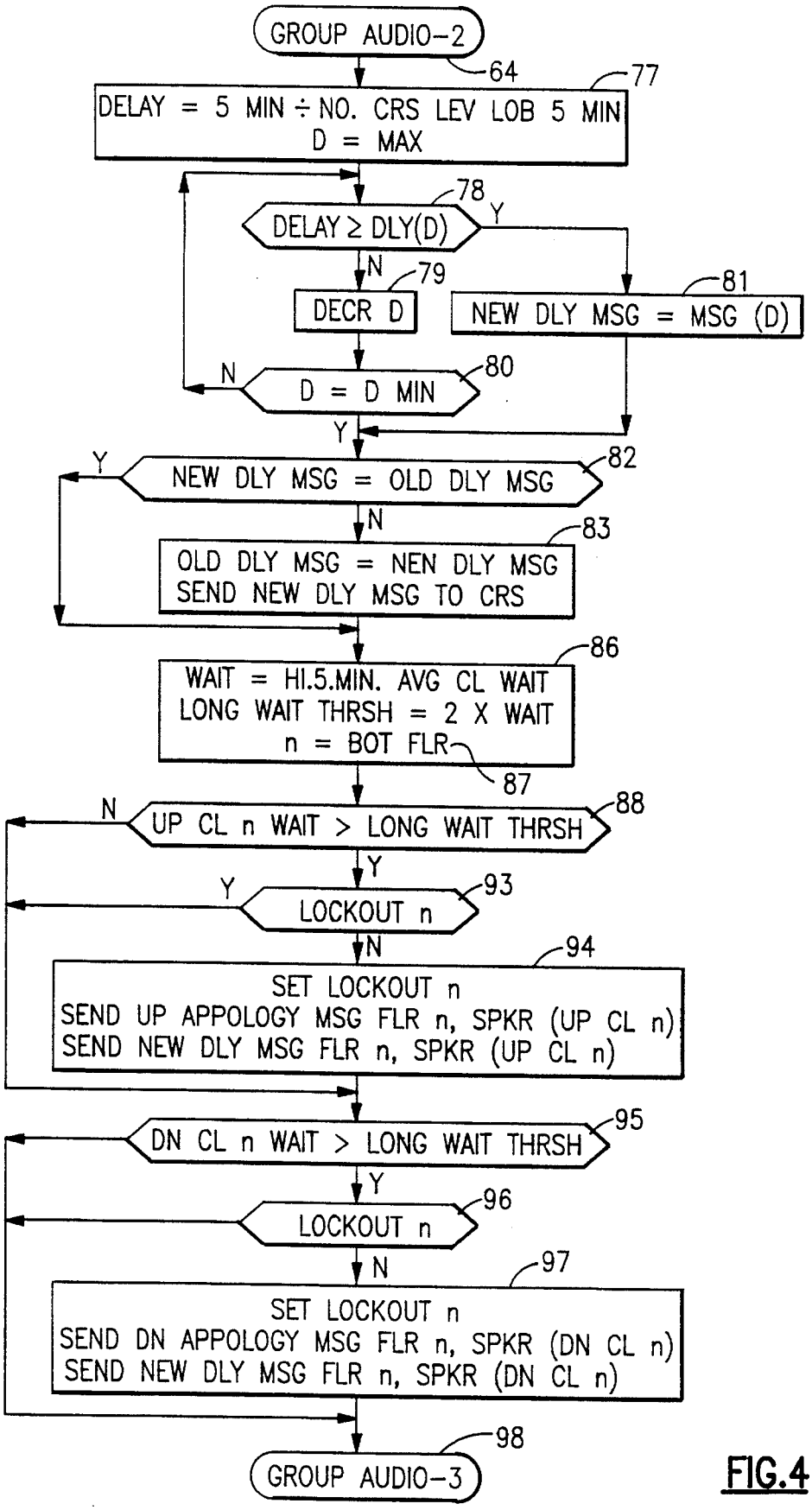

Referring now to FIG. 4, the next subroutine generates a delay message, which is different than the E.T.A. message, because the delay message simply indicates how long it might be before service might become available, whereas the E.T.A. message informs the passenger of how long exactly it will be before the car giving the E.T.A. message reaches the landing. The use of these two messages is described more fully hereinafter with respect to FIGS. 4 and 6. In FIG. 4, a pair of steps 77 generate a delay factor, which is essentially equal to roughly the time between successive cars leaving the lobby, on average, during the last five minutes. Of course, the cars do not remain spread apart by the same amount of time as the average of time when they leave the lobby, but it is an indication of the general traffic and service level in the building. Thus, if there are six cars, but only five cars leave the lobby during the past five minutes, then there is roughly one car per minute moving around in the system. In the steps 77, a factor D relating to the delay messages which can announce a suitable delay, is set to its maximum amount. Then a test 78 determines if the recently calculated delay factor is equal to or greater than the delay factor associated with D. If not, the factor D is decremented in a step 79 and a test 80 determines if all of the D factors have been tested or not. If not, the subroutine reverts to test 78 where, eventually, the delay factor will be greater than that associated with the current value of D. This reaches a step 81 where the new delay message is set equal to the message related to D. This message may be: "The next car should be here in about 40 seconds", or some other suitable language. Then a test 82 determines if the new delay message is the same as the old delay message, and if not, updates the old delay message to equal the new one and makes the new delay message available to the cars in a pair of steps 83; otherwise, these steps are bypassed.

Next, a call wait threshold is generated in a pair of steps 86 in which a WAIT factor is set equal to the high five minute average call waiting period in the building, and then the long wait threshold is generated as twice the WAIT factor. Then in order to determine whether or not any calls in the building have been waiting for a long time, as compared with the long wait threshold, a step 87 sets the floor factor, n, to the bottom floor and a test 88 determines if there is an up call for floor n which has been waiting for a period of time longer than the long wait threshold. If so, a test 93 determines if floor n is locked out, as described hereinbefore. If it is locked out, then no announcement is made in this pass through the routine of FIG. 4. If it isn't locked out, then a plurality of steps 94 set the lockout at floor n, thereby prohibiting other messages, and sends an "up apology" message to floor n at the speaker of the car which at the present moment has been assigned to answer the up call at floor n (even though it may not ultimately be that car which has the final assignment in response to the call). The purpose is: it is more likely to be this car than any other; and it is quite unlikely that the currently assigned car would be eliminated from answering such a call (as with a car that is already past the call). And the new delay message is sent to the same speaker, immediately following the apology message. The combinations of these messages might be something like: "We are sorry for the delay in answering your up call. The next car should be here in about 50 seconds". After handling up calls, the test 95 determines if floor n has a down call that has waited for longer than the long wait threshold. If so, a test 96 determines if a lockout is in effect. Obviously, if there are both down and up calls on floor n which have been waiting too long, the down call will be locked out while the up call apology and delay message area being announced. If not locked out, a series of steps 97 will set the lockout for floor n, and send the down apology message and the delay message to the floor and speaker of the elevator car which is currently assigned to answer the down call at floor n. And then, the next part of the group audio control routine, shown in FIG. 5, is reached through a transfer point 98.

Figure 5:
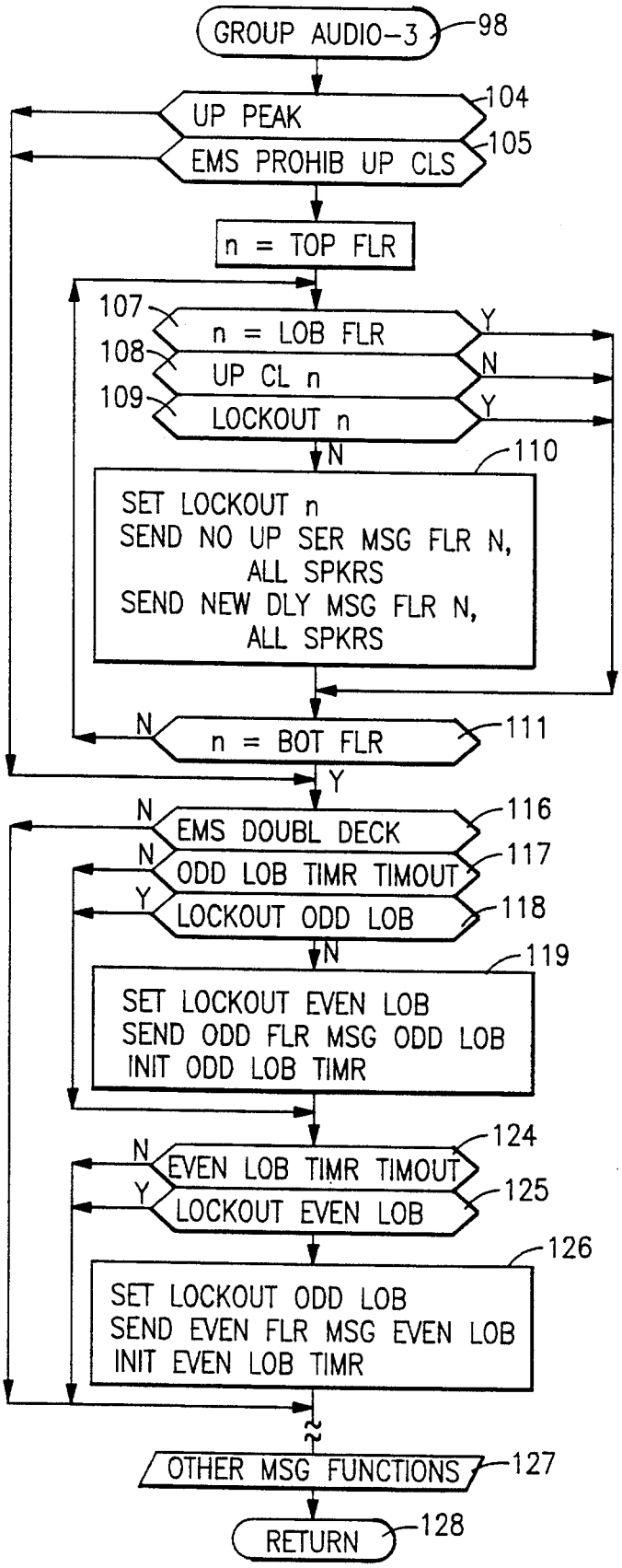

The first subroutine in FIG. 5 relates to informing passengers when, during up peak, up hall calls from non-lobby floors are not being answered, requiring the passenger to proceed downward to the lobby in order to enter onto a proper, up peak car for transfer to the desired floor. A first test 104 determines if the up peak mode of operation is in process, or not. If so, a test 105 determines whether the elevator management system currently prohibits up calls during the up peak mode. If it does, the floor factor, n, is set equal to the top floor in a step 106 and a test 107 determines if the floor is the lobby floor. If it is, of course no announcement is necessary since all lobby passengers may travel upwardly during up peak. But if floor n is not the lobby floor, then a test 108 determines if there is an up call on floor n. If so, a test 109 determines if floor n is locked out or not. If it is not, a series of steps 110 set the lockout for floor n, and send a no up service and delay message to all of the speakers of floor n (because there is no particular car involved, and therefore maximum assurance of audibility can be obtained). An opposite result of one of the tests 107–109 will bypass the steps 110. Then a test 111 determines if all of the floors have been tested for impermissible up calls, or not. If not, the subroutine reverts to the test 107.

Eventually, all of the floors are tested for impermissible up calls, and an affirmative result of test 111 will reach the next subroutine which provides odd and even floor service information to potential passengers of double deck elevators. A test 116 determines if the elevator management system has enabled double deck elevator operation, or not. In the usual case, whenever double deck elevators are installed, they will be used as such. Therefore, an affirmative result of the test 116 will reach a test 117 to determine if an odd lobby timer has timed out. A timer is utilized to let the odd (and even) lobby message repeat, over and over, for so long as double deck operation is enabled. This is in contrast to other messages herein which are provided only with respect to a single landing and with respect to or until a particular service is provided at that landing. The speaker for the double deck lobby announcement might be separate from the individual car speakers 21 since its purpose is simply to direct passengers toward the upper or lower lobby, for access to the upper or lower section of the elevator, depending upon the destination floor. Such a speaker could, therefore, be located partway down a ramp leading to the particular lobby floor involved, or in some other useful location. If the odd lobby timer has timed out, an affirmative result of test 117 reaches a test 118 to determine if the odd lobby speaker is locked out so as not to interfere with the even lobby speaker. If not, a series of steps 119 will set the lockout of the even lobby speaker, send the odd lobby floor message to the odd lobby speaker and initiate the odd lobby timer in order to determine when the next odd lobby message should be given. The odd lobby floor message may be: "For all odd numbered floors, please proceed to the upper lobby". Whenever it is not yet time for the odd lobby message to be repeated or whenever the odd lobby speaker is locked out due to the even lobby message, the steps 119 are bypassed. Then a test 124 determines if the even lobby timer has timed out. If so, a test 125 determines if the even lobby is locked out due to an odd lobby message. If not, a series of steps 126 will set the lockout for the odd lobby speaker, send the even message to the even lobby speaker and initiate the even lobby timer. When the subroutine is complete, other subroutines 127 relating to similar functions may be performed, if desired, and then other parts of the program are reverted to through a return point 128.

The elevator control system 23 also causes audio control routines to be performed for each of the elevator cars. The audio control routine for car four is reached in FIG. 6 through an entry point 131 and a first test 132 determines if a fire mode of operation is in place. If so, the car audio routine is bypassed and other parts of the program are reverted to through a return point 133. If not, a negative result of test 132 reaches a test 134 to determine if the elevator management system permits audio announcements at the current time, and if so, a test 135 determines if the elevator management system permits audio announcements for car five. Assuming that these are both positive, a floor factor N is set equal to the bottom floor in a step 136. This is used to step from floor to floor and determine when announcements for this car should be made relative to the specific floor.

Figure 7:
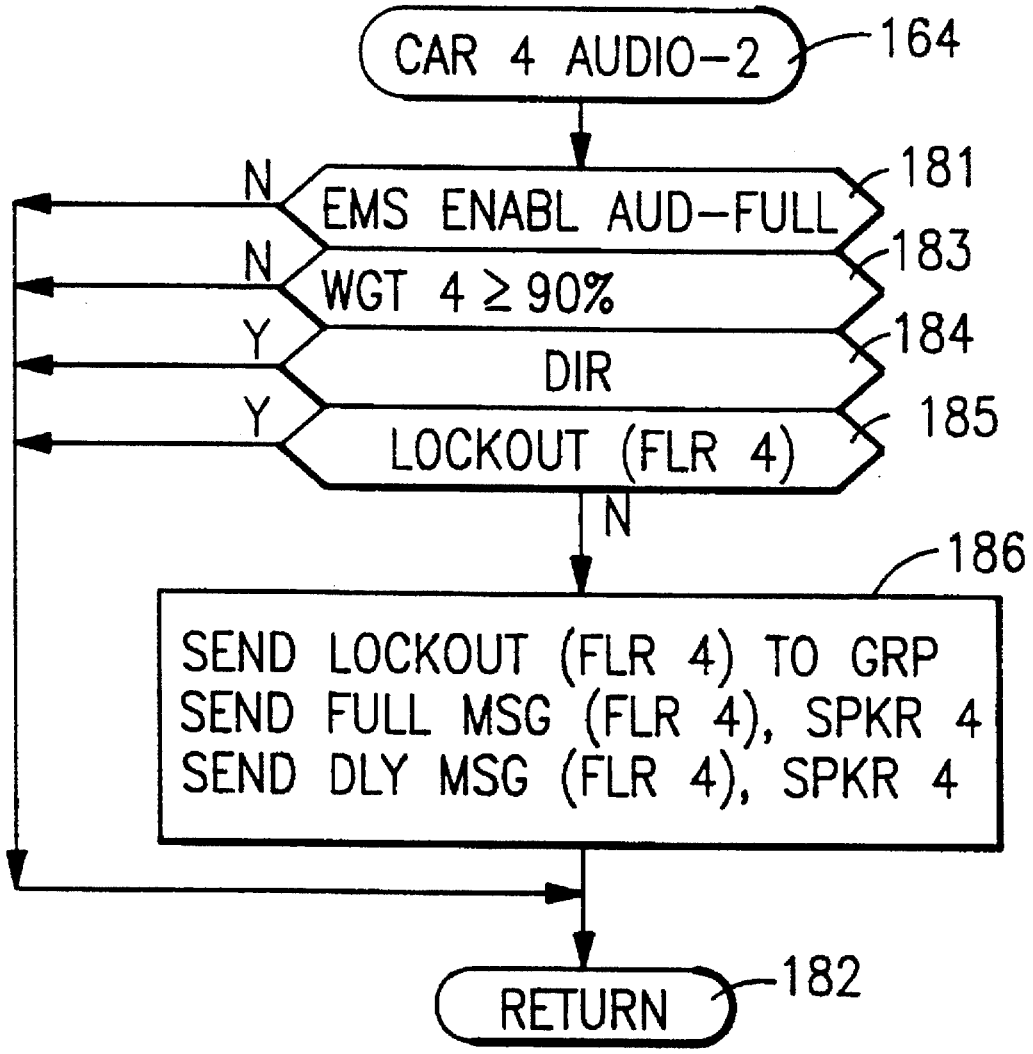

A first test 137 determines whether audio announcements are allowed on the particular floor. They might not, permanently or on particular occasions, for instance where the elevator opens into the operative space of a facility, rather than simply into a corridor connected by hallways to operative spaces. If audio announcements are permitted on floor N, a test 138 determines if the committable floor of the car is the lobby floor. If the lobby floor is the floor under consideration, an affirmative result of test 138 reaches a test 139 to determine if the up peak mode of operation is in effect. If it is, then a test 140 determines if channeling is being used during peak periods. If channeling is being used during peak periods, then the passenger must enter must board the car assigned, for its next run, to the group of floors which includes the passenger's destination floor. To do this, the present invention provides channeling announcements directly at each elevator so passengers are attracted to the elevator serving the group of floors including their own destinations; this is an important aspect of the invention. An affirmative result of the test 140 will reach a test 145 to see if the elevator has been assigned upward direction. This is a point in time following the loading of passengers at each floor when the doors close and the elevator readies to proceed upwardly. At this time, a plurality of steps 146 are reached to reset various factors which are described hereinafter. Prior to having direction, as the elevator stands at the lobby boarding passengers, a negative result of test 145 reaches a test 147 to determine if a local channel initiation flag has been set or not. Initially, it will not have been set so a negative result of test 147 reaches a pair of steps 148 in which the service ability of all the car call buttons on the car operating panel are disabled from use, and the display 24 in front of the elevator is reset. This latter step may be redundant but it is to ensure that only the desired numbers will be displayed. Then a test 149 determines if the floor currently under consideration, floor N, is within the group of channel floors currently assigned to car four. If floor N is not within the current channeling assignment for car four, a negative result of test 149 reaches a test 150 to determine if a channel low number flag has yet been set or not, as described hereinafter. Until the low floor of the channeling group has been reached, tests 149 and 150 will be negative, thereby bypassing any further functions with respect to floor N. This reaches a step 151 which increments the value of N so that the next floor may be given consideration. And a test 152 determines if all the floors have been considered or not. Initially, they will not have, so a negative result of test 152 reverts the routine to the test 137. If audio announcements are permitted and the car's committable floor is the lobby during up peak and channeling mode, prior to having direction, the test 147 will again be reached. For this floor, initially the result of test 147 will be negative reaching the steps 148 which redundantly reset the car call panel and the display. Once again, the test 149 will determine if this floor is within the channeling group currently assigned to car four. Assuming that it is, an affirmative result of test 149, indicating that floor N is the lowest floor in the group of channel floors currently assigned to car four, will reach a step 155 where the car call button for floor N is enabled. Then, a test 156 determines if the channel low floor flag has been set or not. Initially, when handling the first floor of the channel group, a negative result of test 156 will reach a pair of steps 157 in which the channel low number (for use in the display 24) is set equal to the floor number of floor N, and the channel low floor flag is set. The channel low floor flag is an indication that successive floors are those that are within the channel group, but not the low floor. Then a step 160 sets the channel high floor number (for use in the display 24) to floor N. Obviously, when the first floor of the channel group is being set, this is not the correct number; however this number will be overwritten until the end of the group is reached, as described hereinafter. Then the test and step 151, 152 determine if all floors have been tested, and if not, revert to test 137 for the next floor in a sequence. Assuming the conditions are the same, test 149 will again be affirmative and the step 155 will enable an additional car call button for the current floor. Then, the test 156 will determine that the channel low floor flag has already been set so as not to alter the low number used in the display 24. And, the channel high floor is set equal to the current floor in a step 160 as before. Then N is incremented and test 152 again causes reversion to the step 137. In this pass, test 149 is affirmative enabling yet another car call button for the current floor. Test 156 is also affirmative so the high floor number for the display 24 is again changed to the current floor in the step 160. This continues until all of the floors within the group of floors relating to the current channel assignment for car four have been examined, and their car call buttons enabled. Then N is incremented in the step 151 one more time and test 152 reverts the routine to test 137. After all of the floors in the assigned channeling group have been tested, the next time the test 149 is reached, a negative result will occur. Since the channel low number flag has been set, an affirmative result of test 150 indicates that all of the floors within the channel have been handled. At this time, the display 23 can be lit (steps 161) displaying the low and high numbers for the channel. It should be understood that any channeling system has the provision for creating the display 24; but such has been integrated with the audio control functions herein for clarity. If desired, the display numbers can be generated in any other suitable way, separately from generation of the audible channeling message. Once the floors in the channeling group have been identified, a channel initiation flag is set (steps 61) to indicate that the identity process is complete. Then a step 162 determines if the lobby is locked out from further audio messages. If not, a series of steps 163 will send a lockout lobby request to the group (so that the group can set the lockout for the lobby as described hereinbefore), send a channel message to the lobby speaker of car four, and initiate a channel timer. The message might be: "Floors 2–14 at car 1, this way", or any other suitable message identifying the car number and the floors being served thereby. This time, the floor number, N, is not incremented, since completion of the channel identification process ends the need to test any more floors. Therefore, once the message has been sent and the timer initiated, or once it is determined that a lockout is in effect, the next portion of the car four audio control routine, in FIG. 7, is reached through a transfer point 164.

Figure 6A:
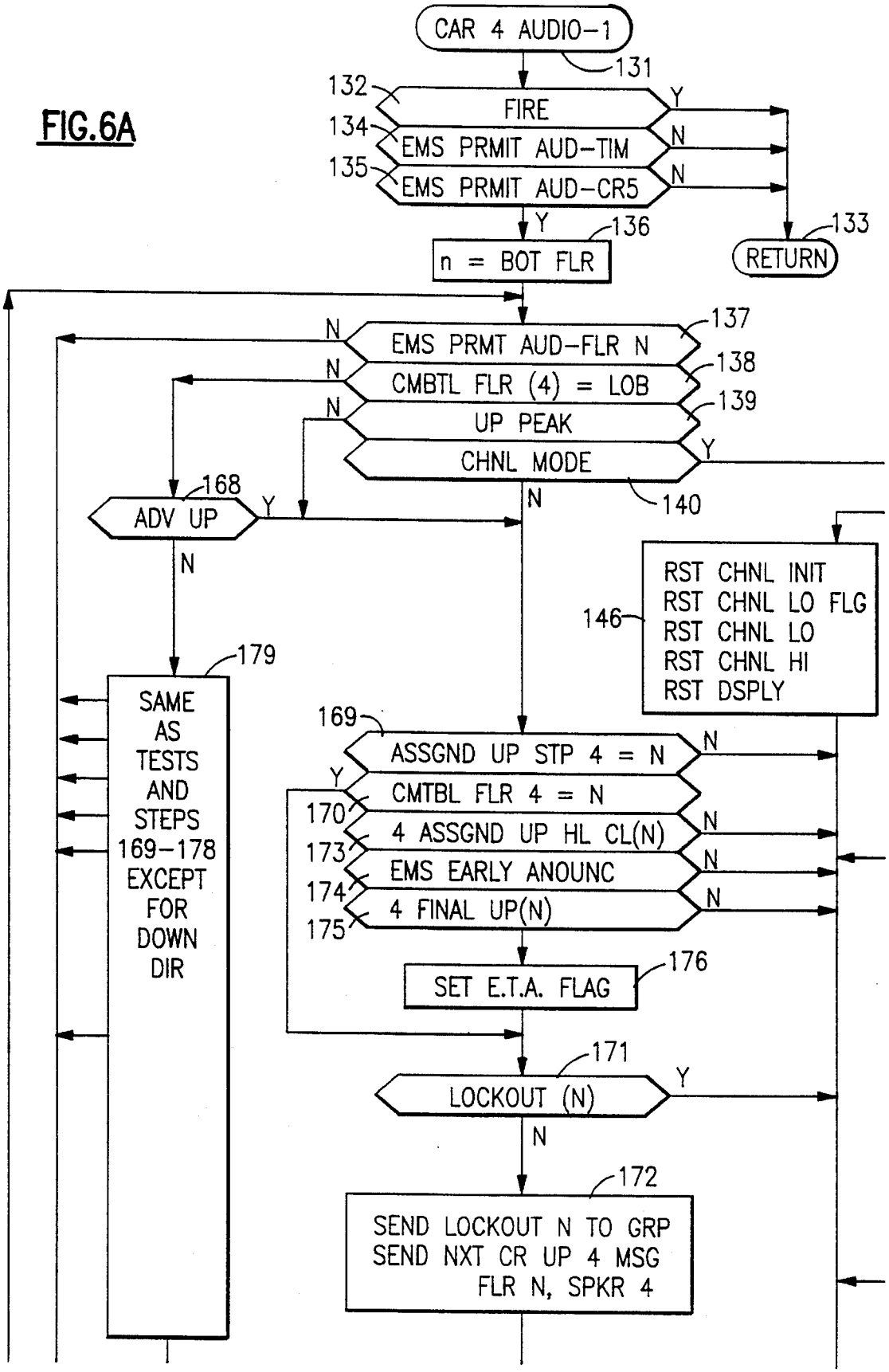
FIGS. 6, 6*a*, 6*b*, 6*c*, 6*d* and 7 are a logic flow diagram of an audio control routine for a typical elevator car in accordance with the invention.
Figure 6B:
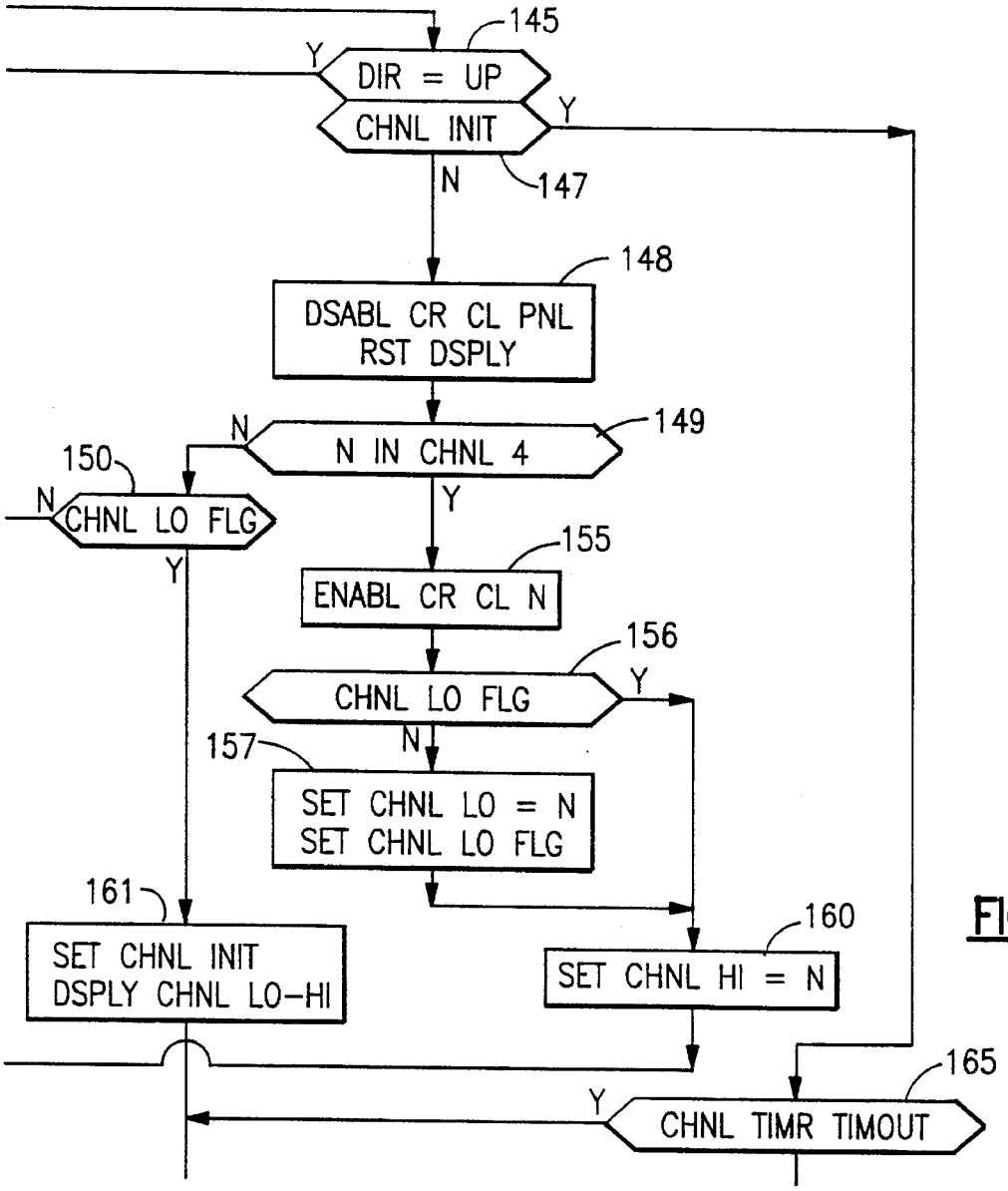
Figure 6C:
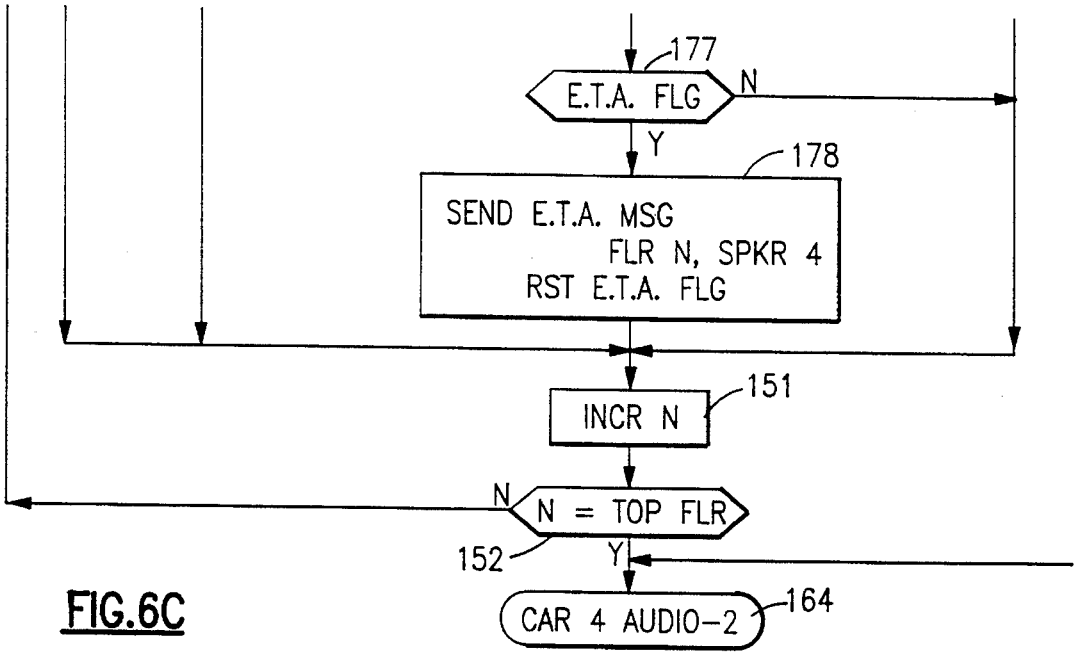
Figures 6, 6D:
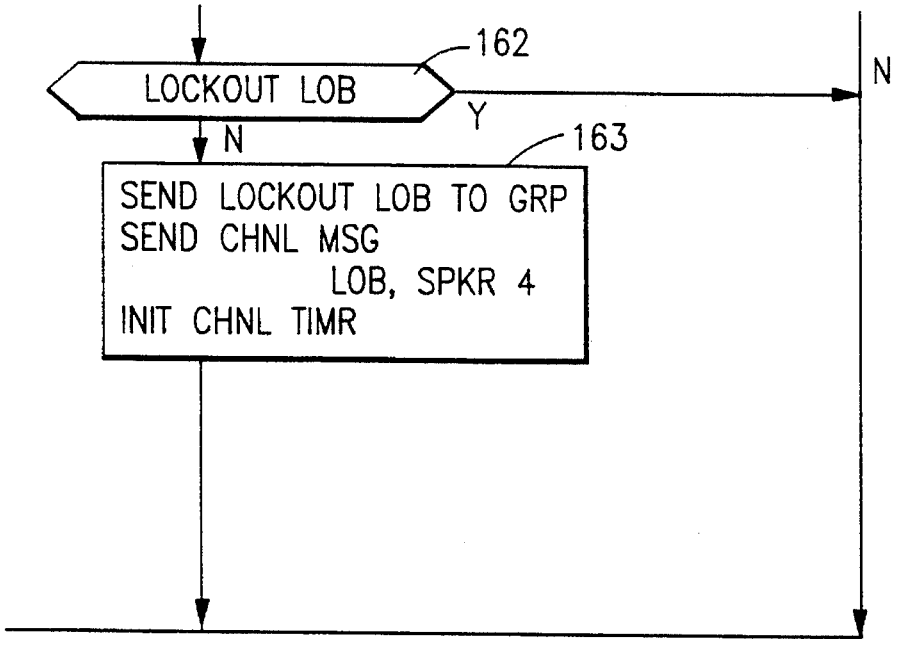

In the next pass through the routine of FIG. 6, assuming the conditions are the same, when the lobby floor is reached, test 147 will be affirmative reaching a test 165 to determine if the channel timer has timed out (if initiated in steps 163, hereinbefore) or was not even initiated (due to a lockout at test 162), which responds the same as a timeout. If not, no other functions are performed for the lobby floor and the routine is advanced through the transfer point 164. The channel timer may time out before the car leaves the lobby floor. If it does, affirmative results of tests 147 and 165 will reach test 162 to see if the lobby audio system is locked out. If it is not, then the message will be announced and the channel timer will be initiated in the steps 163. In this fashion, one, two or three announcements may be made before the car is caused to leave the lobby for its next upward run. Once the car gets ready to leave the lobby, in a subsequent pass through the routine of FIG. 6, test 145 will be affirmative as soon as the car gets direction, reaching the steps 146 so that all of the flags and numbers, as well as the display 23, are reset. This reestablishes the system for the next time that car four will announce its channeling at the lobby. If desired, the delay message can be sent along with the channel message, either every time, or the second time, in an obvious fashion, so as to give passengers the option of waiting for the next car which may be less full. One way to achieve this is simply to cause the steps 163 to send the delay message to the lobby speaker of car four immediately following sending of the channel message.

If the committable floor for car four is not the lobby, then a negative result of test 138 will reach a test 168 to determine if car four has a generally upward advancement direction. If it has, a group of tests (169 et seq.) relating to the up direction of the elevator are reached. In the event that up peak is in effect so that test 139 is affirmative, but the channeling mode of operation is not in effect so test 140 is negative, then the same series of steps are reached which are used at other floors of the building as well. Thus if up peak is not in process then the lobby floor is treated like any other floor and those same steps will be reached by a negative result of test 139. Specifically, a first test 169 determines if car four has an assigned stop in the up direction at the floor being considered. In this embodiment, an up stop means either an up hall call or a car call when traveling upwardly. If there is a stop called for, then a test 170 determines whether the floor in consideration is in fact the committable floor for car four. If it is, an affirmative result of test 170 reaches a test 171 to determine if the floor under consideration has an audio lockout in effect. If not, a plurality of steps 172 send a lockout request for floor N to the group and a "next car up is car four" message to the loudspeaker of car four on the floor under consideration. Thus, as the car approaches a floor at which it has an immediately impending stop, it will announce that the next car in that direction is car four (or such other appropriate car identification as may be desired) so that people can move toward the announcement (speaker) and recognize that it is car four rather than some other car to which they are responding. In the case of the visually impaired which use the building regularly, the mere announcement that it is car four is helpful, but the direction will be far more meaningful to those who have a visual impairment than it will to those who are accustomed to relying on visual cues. If the floor in question is not the committable floor of car four, a negative result of test 170 reaches a test 173 to determine if car four is assigned an up hall call at floor N. If it is, an affirmative result of test 173 reaches a step 174 to determine if the elevator management system has enabled early announcement, that is, fixing a hall call assignment at some threshold period of time prior to the time at which the car assigned to the call will be at the stop control point for the call floor, as described in the aforementioned '484 patent. If early announcement is being used, and (as alluded to hereinbefore with respect to tests and steps 63–72 in FIG. 3) if the amount of advance notice is sufficient that use of an E.T.A. message makes sense, then an E.T.A. message may be sent. However, in a typical relative response assignment system, the call is assigned to an appropriate car many times per second, and this may not be the same car that finally answers the call. Therefore, it must be assured that the call assignment to car four is a final assignment as indicated in the '484 patent. This is determined in a test 175. If it is known that car four will be answering the up call on floor N, an affirmative result of test 175 reaches a step 176 to set an E.T.A. flag. Then the test and steps 172 will send the "next car up is car four" message to the car four speaker on floor N, if possible. Then a test 177 checks the E.T.A. flag and if set, causes the E.T.A. message to be sent to speaker four on floor N, immediately following the next car up message of steps 172, and the E.T.A. flag is reset, all in steps 178. Therefore, the steps and tests 169–172 are operative on every floor, except on the lobby floor when channeling, to announce when car four is to be the next car responding to an up call or at the lobby. And, the steps and tests 171–178 provide early announcement that the next car up will be car four when early announcement is permitted, and provide an E.T.A. message if appropriate.

If in test 168 it is determined that the direction of the elevator is not up, then a series of steps and tests 179 are reached which perform the same functions as the steps and tests 169–178, but all related to the down direction.

Regardless of whether the car is traveling up or down, channel mode or not, after each pass through the routine of FIG. 6, within which it either identifies the channel floors or examines all of the floors for either up calls or down calls and makes appropriate announcements, when possible, the routine thereafter advances through the transfer point 164 to a subroutine in FIG. 7 which provides a "car full" audio announcement. In FIG. 7, a first test 181 determines if the elevator management system has enabled audio announcements concerning a full elevator. If not, a negative result of test 181 causes processing to revert to some other part of the program through a return point 182. Then a test 183 determines if the weight in car four exceeds 90% of its design weight (sometimes referred to as contract weight). If not, no announcement is necessary so the return point 182 is reached. But if the car is full, then a test 184 determines if the car has direction, which means it is not standing at a floor receiving passengers and no announcement is necessary. In that case, an affirmative result of test 184 reaches the return point 182. The test 185 determines if a lockout is in effect on the floor where car four is standing. If so, no announcement is possible; otherwise, a plurality of steps 186 will send out to the group a lockout request for the floor at which car four is standing, send the "car full" message to the car four speaker on that floor, and then send the delay message (described hereinbefore at step 81, FIG. 4) to the same speaker. The full message might be: "This car is full. Please use next car", which may be immediately followed by the delay message. Of course, the delay message need not be used with the "car full" message, if such is desired in any implementation of the invention. Another embodiment of the invention can utilize the weight of the car as an indication of the fact that the car may be becoming full, and issue a delay message without issuing the "car full" message. In FIG. 7, this might be achieved by lowering the percentage utilized in step 183, such as to 70% of design weight, and then causing the steps 186 to send the lockout and the delay message, without sending the car full message. This is an option which simply allows informing passengers when the next car is coming, should they want to know. In yet another embodiment of the invention, each time that car loading is in process, the delay message can be sent to the speaker system of that car, just for information, if desired.

The embodiments described herein are exemplary merely. Rather simple factors have been used for the E.T.A. message and for the delay message, but far more complex factors could be utilized to determine the content of such messages. The exact nature of the messages is, of course, irrelevant to the invention; any desired messages may be used as appropriate in any implementation of the invention. Although a number of different messages have been described herein, it should be understood that any of them can be used without others, selectively, as is desired. Similarly, messages relating to the stairwells can be used even if such messages are not used with respect to elevator cars, and messages may be used at each of the elevator cars even though emergency messages are not provided for at the stairwells. Of course, the underlying dispatching control system with which the invention may be used is also irrelevant to the invention; a wide variety of known dispatching systems are available, and any system may take advantage of the precepts of this invention regardless of the nature or implementation of the control system with which it may be used. The lockout system may be replaced with some other system to avoid speaker interference. The manner of beginning and ending the lockout system may be altered from that described herein; for instance, instead of using the lockout timer, a more sophisticated system may be utilized which actually senses the end of each message in order to permit the next message in the interfering area to occur. A different method may be used to determine when a long waiting call has occurred, and a different factor to determine what to announce to a long waiting call may be employed; similarly, the announcement to a long waiting call, different from the apology message disclosed herein may be used to provide comfort to someone who has been waiting for service for too long a period of time, all within the precepts of the invention. In FIG. 6, provision is made by test 169 to announce cars which are about to stop in response to a car call, as well as a hall call. This may prove to create confusion, rather than being helpful. In such a case, test 169 could be altered to be affirmative only in response to assigned up hall calls.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. An elevator system serving a plurality of floors in a building having a stairwell and having a door on each of said floors to provide access from a related floor to said stairwell, comprising:

a plurality of first speaker systems, each of said first speaker systems corresponding to and disposed in proximity with a corresponding one of said doors, each of said first speaker systems including an audio acoustical transducer and signal responsive means for causing said transducer to emit selected audible announcements in dependence on message signals provided thereto; and a plurality of second speaker systems, each of said second speaker systems disposed on each floor of said building in proximity with an elevator corridor on the related floor; and a controller for providing a fire signal indicative of the fact that a fire emergency mode of elevator operation is in effect in the building, in which mode the elevators are rendered non-responsive to ordinary passengers, and for providing, in response to said fire signal, a fire message signal to at least one of said first and second speaker systems on each of said floors of the building to cause at least one of said first speaker systems to announce the presence of the stairwell and to cause at least one of said second speaker systems to announce that passengers should not use the elevator and should use the stairwell.

2. An elevator system as recited in claim 1 wherein at least one of said second speaker systems is disposed in proximity with a gate, the gate disposed in the elevator corridor for providing passenger access between an elevator car and the elevator corridor.

3. An elevator system as recited in claim 1 wherein said controller receives hall call and car call requests for service and causes elevator cars to provide service in response thereto if said controller is not in the fire emergency mode, said controller providing a next car message signal to a selected one of said second speaker systems which corresponds with a corresponding car providing specific service to the related floor, said next car message causing said selected speaker system to announce said specific service, thereby to provide an audible cue to assist passengers in locating said specific service.

4. An elevator system according to claim 3 wherein said controller provides said next car message signal in response to said controller assigning a hall call request for service at said related floor to said corresponding car.

5. An elevator system according to claim 4 wherein said controller irrevocably assigns said corresponding car to provide said specific service at a point in time which is a threshold time in advance of the time when said corresponding car will arrive at said related floor, and said controller provides said next car message signal immediately after said point in time.

6. An elevator system according to claim 5 wherein said controller provides an estimated time message signal to said selected speaker system to cause said selected speaker system to announce that the next car will arrive in a period of time related to said threshold time.

7. An elevator system according to claim 4 wherein said controller provides said next car message signal to cause said selected speaker system to announce that said specific service will be in a determined direction.

8. An elevator system according to claim 7 wherein said controller provides said next car message signal immediately before said corresponding car arrives at said related floor.

9. An elevator system according to claim 3 wherein said controller provides said next car message signal in response to said corresponding car having a car call request for service to said related floor.

10. An elevator system according to claim 9 wherein said controller provides said next car message signal immediately before said corresponding car arrives at said related floor.

11. An elevator system according to claim 9 wherein said controller provides said next car message signal to cause said selected speaker system to announce that said specific service will be in the travel direction of said corresponding car.

12. An elevator system according to claim 3 wherein said controller provides said next car message signal immediately before said corresponding car arrives at said related floor.

13. An elevator system according to claim 3 wherein said controller provides said next car message signal to cause said selected speaker system to announce the direction in which said corresponding car will be traveling when it leaves said related floor to provide said specific service.

14. An elevator system according to claim 3 wherein said related floor is a floor other than a lobby floor.

15. An elevator system according to claim 3 wherein said related floor is a lobby floor.

16. An elevator system according to claim 15 wherein said controller assigns said floors to corresponding channeling groups during an up-peak mode of dispatching, said controller assigns each of said cars to one of said channeling groups of floors each time that said car is at the lobby during said up-peak mode of dispatching, and said controller provides said next car message signal to cause said selected speaker system to announce the range of floors within the channeling group of floors to which said corresponding car is assigned.

17. An elevator system according to claim 16 wherein said controller provides said next car message signal to cause said selected speaker system to announce the car identity of said corresponding car.

18. An elevator system according to claim 17 wherein said controller provides a delay message to said selected speaker system to cause said selected speaker system to announce an approximate period of delay before another car will offer said specific service.

19. An elevator system according to claim 3 wherein said controller provides said next car message signal to cause said selected speaker system to announce the car identity of said corresponding car.

20. An elevator system according to claim 3 wherein said controller provides an apology message to one of said second speaker systems on one of said floors at which a hall call request for service has not been responded to by any one of said cars for a long wait threshold period of time.

21. An elevator system according to claim 20 wherein said controller provides a delay message to said one speaker system to cause said one speaker system to announce an approximate period of delay before a car will answer said hall call request.

22. An elevator system according to claim 3 wherein said controller responds to a threshold weight in said corresponding car to provide a car full message to said selected speaker system to cause said selected speaker system to announce that said corresponding car is full.

23. An elevator system according to claim 22 wherein said controller provides a delay message to said selected speaker system to cause said selected speaker system to announce an approximate period of delay before another car will offer said specific service.

24. An elevator system according to claim 3 wherein said controller provides a delay message to said selected speaker system to cause said selected speaker system to announce an approximate period of delay before another car will offer said specific service.

25. An elevator system according to claim 24 wherein said controller provides said delay message while said car is at a floor providing access to passengers.

26. An elevator system according to claim 3 wherein said controller provides an estimated time message signal to said selected speaker system, to cause said selected speaker system to announce the estimated time remaining before the arrival of said corresponding car at said particular floor.

* * * * *